US009113707B2

(12) United States Patent
Moore

(10) Patent No.: US 9,113,707 B2
(45) Date of Patent: Aug. 25, 2015

(54) CONVERTIBLE CHAIR

(71) Applicant: Ronald Moore, Prescott, AZ (US)

(72) Inventor: Ronald Moore, Prescott, AZ (US)

( * ) Notice: Subject to any disclaimer, the term of this patent is extended or adjusted under 35 U.S.C. 154(b) by 216 days.

(21) Appl. No.: 13/905,334

(22) Filed: May 30, 2013

(65) Prior Publication Data

US 2014/0354018 A1 Dec. 4, 2014

(51) Int. Cl.
*A47B 85/04* (2006.01)
*A47C 4/10* (2006.01)

(52) U.S. Cl.
CPC . *A47B 85/04* (2013.01); *A47C 4/10* (2013.01); *A47B 2220/07* (2013.01)

(58) Field of Classification Search
CPC ..... A47B 85/04
USPC ..... 297/119, 120, 122, 124, 125, 126, 297/378.1, 129
See application file for complete search history.

(56) References Cited

U.S. PATENT DOCUMENTS

| | | | |
|---|---|---|---|
| 212,778 | A | 2/1879 | Woolverton |
| 3,134,622 | A | 5/1964 | Leachman, Jr. |
| D214,438 | S | 6/1969 | Barghout |
| D256,857 | S | 9/1980 | Tallon |
| 4,359,243 | A | 11/1982 | Crutcher |
| 4,390,204 | A | 6/1983 | Fleishman |
| 4,533,174 | A | 8/1985 | Fleishman |
| 4,550,950 | A | 11/1985 | Fleishman |
| D343,741 | S | 2/1994 | Kato et al. |
| 5,624,153 | A | 4/1997 | Censullo |
| D390,022 | S | 2/1998 | Jus |
| D393,375 | S | 4/1998 | Lee |
| 8,152,233 | B2 | 4/2012 | Wechter |
| 2001/0038235 | A1 | 11/2001 | Minami |

FOREIGN PATENT DOCUMENTS

| | | |
|---|---|---|
| WO | 81/02383 | 9/1981 |

*Primary Examiner* — Anthony D Barfield

(57) ABSTRACT

A convertible chair includes a base frame, a seat connected to the base frame through first, second, and third legs, a back support connected to the seat via first and second support arms, and at least one hinge assembly interconnecting the chair components. A user can pivot the back support between an upright chair position and a lowered table position wherein an upper surface of the seat and a back side surface of the back support form an essentially planar table surface. At least one locking mechanism can be utilized to selectively lock the back support in the upright position. Additionally, the chair can be folded into an essentially flat storage position. A table leaf is also provided to fit between two adjacent convertible chairs in the table position, to produce an extended table configuration.

17 Claims, 11 Drawing Sheets

CONVERTIBLE CHAIR

BACKGROUND OF THE INVENTION

1. Field of the Invention

The present invention pertains to the art of furniture, and more particularly, to a convertible folding chair.

2. Discussion of the Prior Art

There is an increasing desire in the marketplace for furniture that can meet multiple needs of a user, including the need to make the most of smaller living spaces. In general, different types of folding chairs are well known, including folding chairs that can be folded into an essentially flat storage position. However, there remains a need for furniture that is both attractive and adaptable to different uses within a small environment.

SUMMARY OF THE INVENTION

The present invention is directed to a convertible chair including a base frame, a seat, and a back support including first and second opposing support arms connected at respective upper ends thereof to a main panel. First and second support arms are pivotally connected at respective lower ends to the seat through at least one main hinge assembly. Further, first and second angled support beams are pivotally connected to opposing sides of the seat, and the back support, through the main hinge assembly. The first and second angled support beams are also pivotally connected to the base frame. Additionally, two front legs and a back leg provide additional support for the seat, and are detachably connected to the base frame through respective connecting assemblies.

In a preferred embodiment, the main hinge assembly is in the form of a support rod extending through various channels and apertures formed in the angled support beams, support arms, the seat, and a top portion of the back leg. This configuration enables a user to pivot the various parts about the support rod to convert the chair from an upright chair position, to a lowered table position, and finally, to a folded, storage position.

The chair further includes locking mechanisms or brackets for selectively locking the back support in an upright position. In a preferred embodiment, the locking brackets each include a main panel and a hollow four-sided arm-retaining portion sized to enable a lower end of the respective support arms to be received therein. Apertures within the support arms each have a length sized to enable the support rod to slide within the apertures, such that the support arms can be lifted into and out of the respective locking brackets, and thus move from a locked to an unlocked position. More specifically, when a user desires to convert the chair from an upright chair position to a table position, the user lifts the back support such that the end portions of the respective support arms are withdrawn from the locking brackets, and pivots the back support downward until a front side surface of the back support is supported on the locking brackets, and a back side surface of the back support is essentially co-planar with the upper surface of the seat. The shape of the seat is complimentary to the shape of an opening formed by the back support, such that the seat fits within the opening when in the table position. Further, when a user desires to convert the chair from the table position to a folded storage position, the user disconnects the front legs and back leg from the base frame, folds the legs flat against the lower side surface of the seat, and lowers the seat until the seat is adjacent a front connecting arm of the base frame and is essentially coplanar with the angled support beams and first and second opposing side arms of the base frame.

The present invention can also be utilized in an extended table configuration, wherein a table leaf is supported on leaf supporting portions of two adjacent convertible chairs that have been arranged in the table position. Advantageously, the convertible chair of the present invention can be utilized as a stable chair to support a user, as an essentially planar table, and as an extended planar table in conjunction with a second convertible chair. Thus, the present invention provides multiple layers of space-saving functionality for a minimal cost.

Additional objects, features, and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
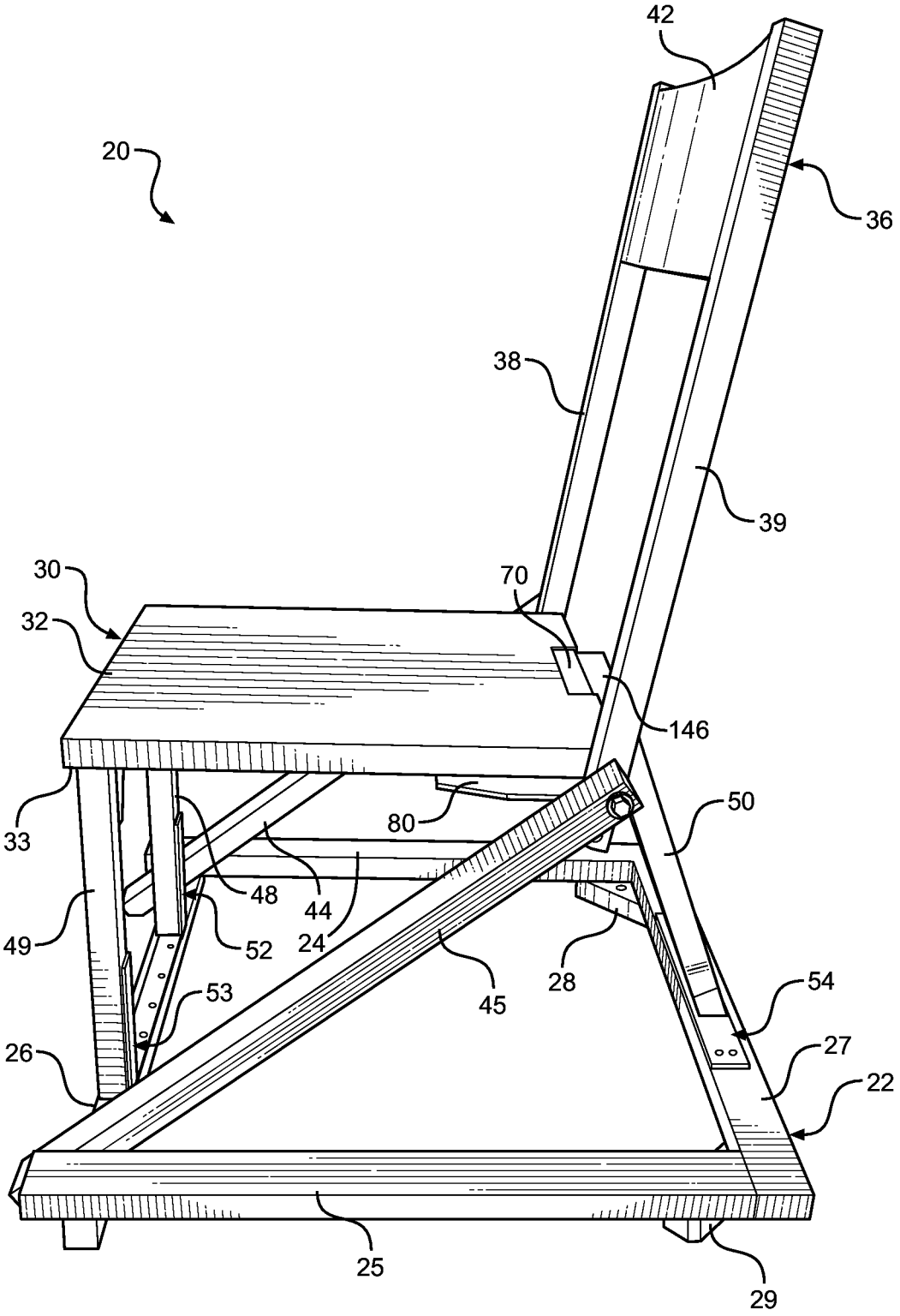
FIG. 1 is a perspective view of a convertible chair of the present invention.
Figure 2:
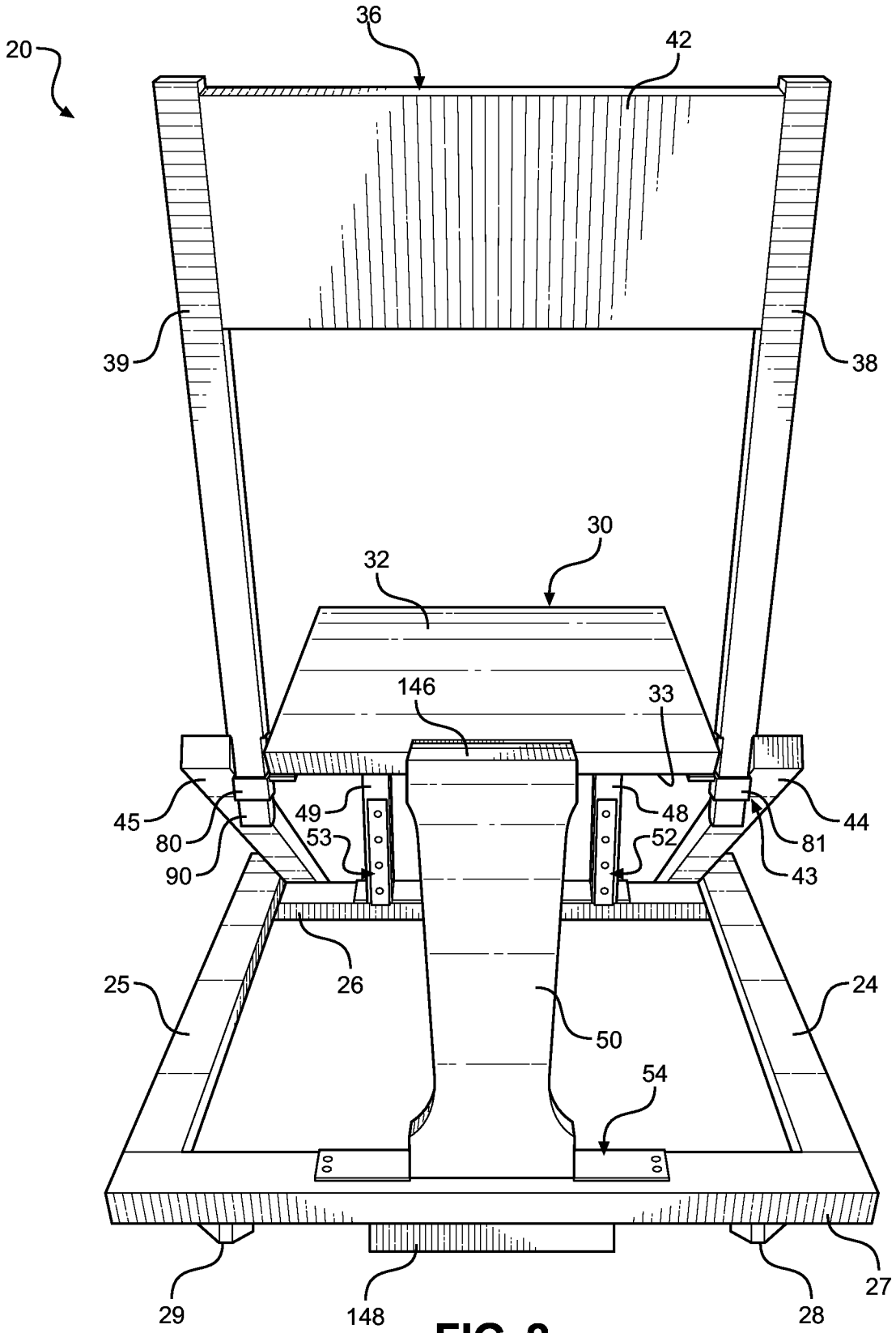
FIG. 2 is a back view of the convertible chair of FIG. 1.

With initial reference to FIGS. 1 and 2, a convertible chair of the present invention is indicated at 20. Chair 20 includes a base frame 22 comprised of first and second opposing side arms 24 and 25 and front and back connecting arms 26 and 27 extending between the first and second opposing side arms 24 and 25. Base frame 22 may also include braces, such as diagonal braces 28 and 29, which add additional support to the connection between back arm 27 and opposing side arms 24 and 25. Chair 20 further includes a seat 30 having upper and lower opposing surfaces 32 and 33, and a back support 36 including first and second opposing support arms 38 and 39 connected at respective upper ends thereof to a main panel 42, and pivotally connected at respective lower ends thereof to seat 30 through a main hinge assembly generally indicated at 43 in FIG. 2. Preferably, chair 20 also includes first and second angled support beams 44 and 45 pivotally connected to opposing sides of seat 30 and back support 36 through hinge assembly 43, and pivotally connected to base frame 22. Additionally, front legs 48 and 49 and a back leg 50 provide additional support for seat 30, and are detachably connected to base frame 22 through respective connecting assemblies 52, 53 and 54.

Figure 3:
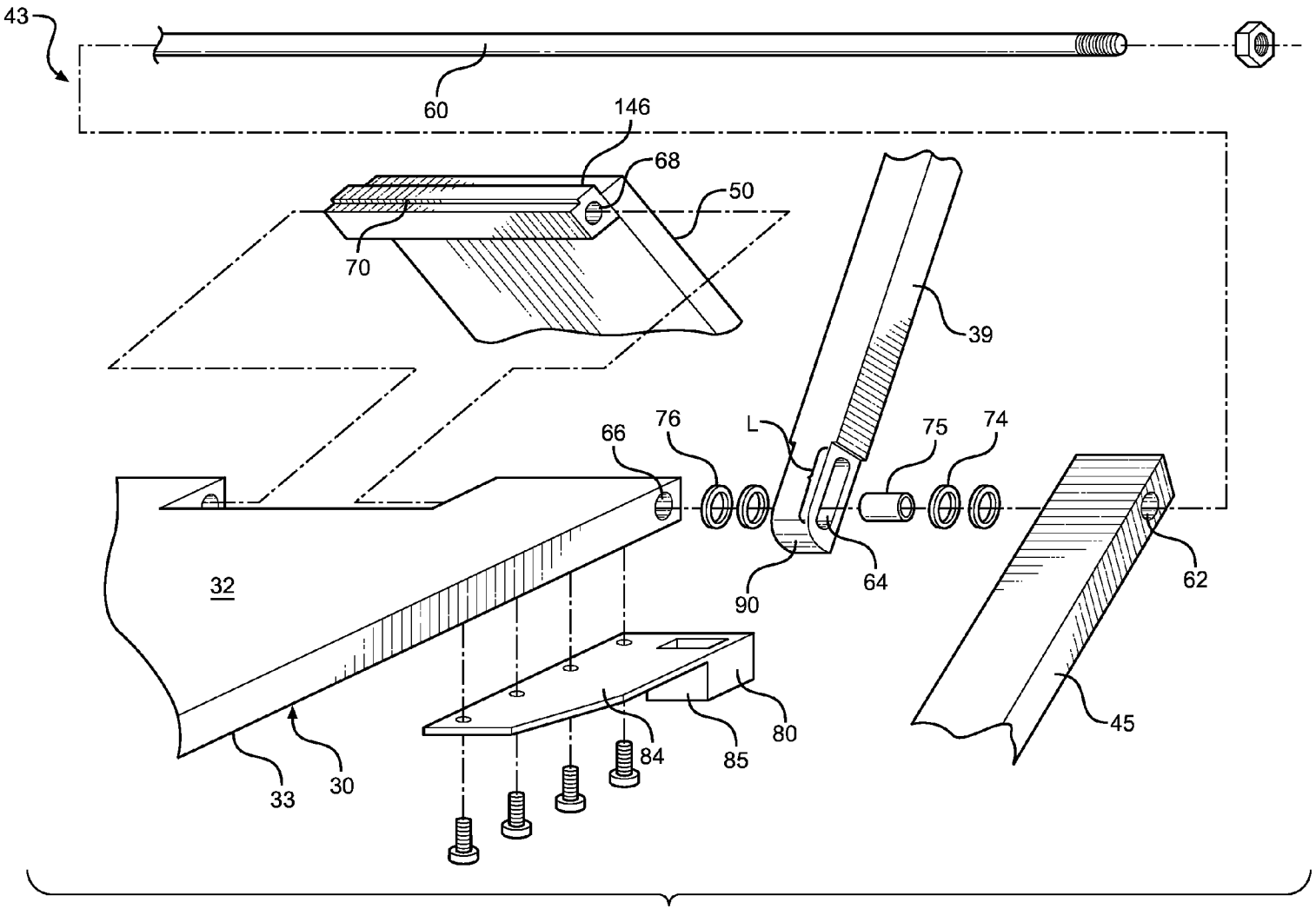
FIG. 3 is an exploded view of a main hinge assembly of the convertible chair of FIG. 1.

A preferred embodiment of main hinge assembly 43 will now be discussed with reference to FIGS. 3 and 4. Although only one side of chair 20 is shown, it should be understood that opposing sides of main hinge assembly 43 are mirror images of one another, such that only one side of chair 20 will now be discussed with respect to main hinge assembly 43. Turning to FIG. 3, main hinge assembly 43 includes a support rod 60 sized to extend through channels 62 formed through respective angled support beams 44 and 45, apertures 64 formed through respective support arms 38 and 39, a main channel 66 formed through seat 30, and an aperture 68 formed through a top portion 70 of back leg 50. Therefore, it should be understood that during assembly of chair 20, support rod 60 extends through channel 62 of support beam 45, a first set of washers 74, a rigid sleeve 75, aperture 64 in support 39, a second set of washers 76, main channel 66 of seat 30 and aperture 68 of back leg 50, before extending through identical elements (not shown) on the opposite side of chair 30. Although not depicted, rear leg 50 may alternatively be pivotally attached to seat 30 via a separate hinge (not shown), such a door hinge or the like.

As best seen in FIGS. 2 and 3, chair 20 further includes locking mechanisms or brackets 80 and 81, for selectively locking back support 36 in an upright position. Although a different locking means for locking the back support in an upright chair position may be utilized, in a preferred embodiment, locking brackets 80 and 81 each include a main panel 84 and an arm-retaining portion 85 extending from a bottom wall of main panel 84. In the preferred embodiment shown, arm-retaining portion is in the form of a hollow four-sided structure sized to enable a lower end 90 of respective support arms 38 and 39 to be received therein. Apertures 64 within support arms 38 and 39 each have a length L sized to enable rigid sleeve 75, through which support rod 60 extends, to slide within apertures 64 such that support arms 38 and 39 can be lifted into and out of respective locking brackets 80 and 81, and thus move from a locked to an unlocked position.

Figure 4:
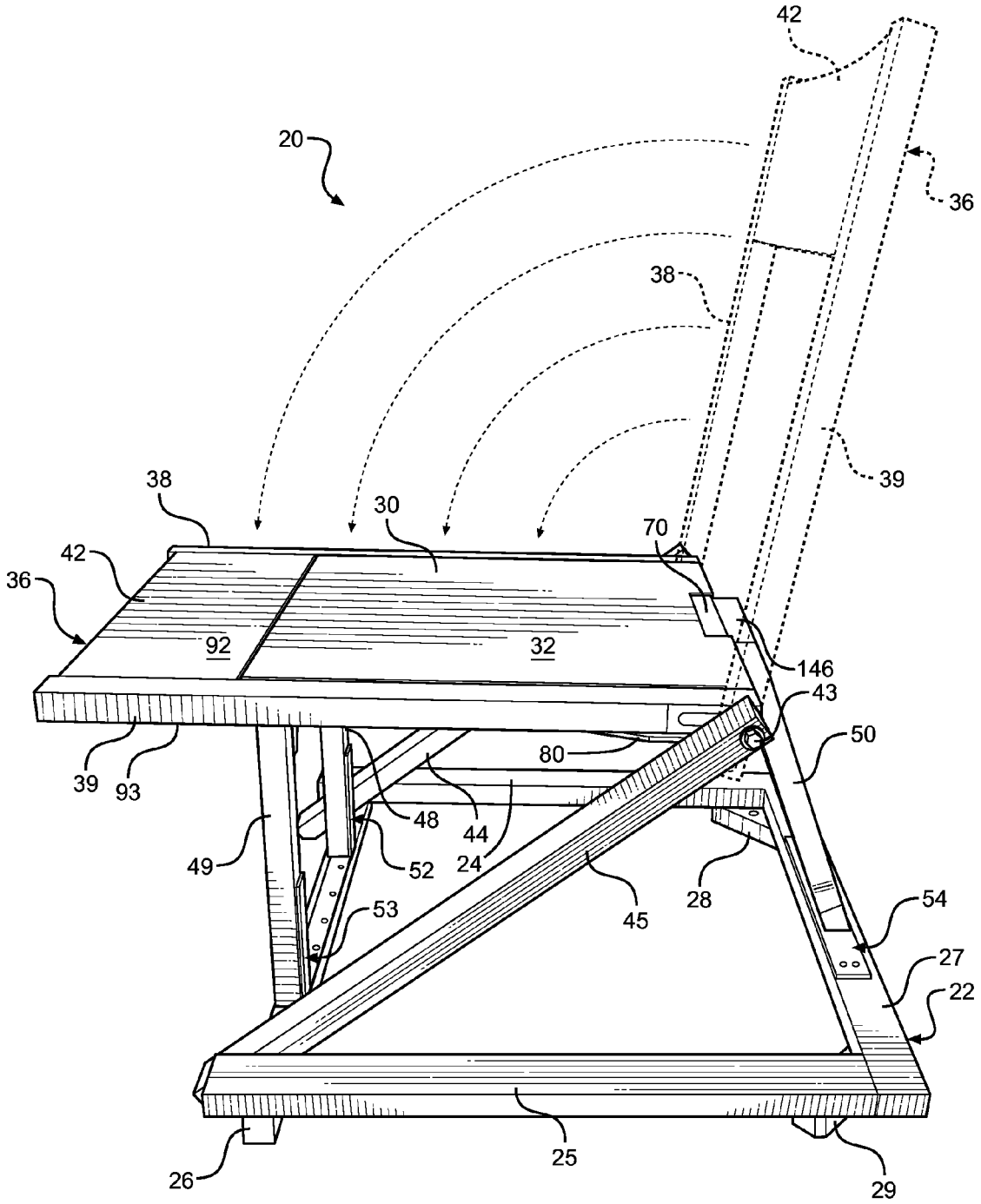
FIG. 4 is a perspective view of the convertible chair of FIG. 1 folded into a table position.

Advantageously, main hinge assembly 43 enables chair 20 to convert from an upright chair position in which back support 36 extends at an angle from seat 30, as shown in FIGS. 1 and 2, to a table position depicted in FIG. 4. More specifically, when a user desires to convert chair 20 from an upright chair position to a table position, the user lifts back support 36 such that end portions 90 of respective support arms 38 and 39 are withdrawn from arm retaining portions 85 of respective locking brackets 80 and 81. Once end portions 90 are free from locking brackets 80 and 81, main panel 42 of back support 36 may be pivoted downward until the back side surface 92 of back support 36 is essentially co-planar with the upper surface 32 of seat 30. As depicted in FIG. 4, the shape of seat 32 is complimentary to the shape of an opening formed by main panel 42 and first and second support arms 38 and 39, such that seat 32 fits within the opening with almost no gaps between the back support and seat 32 when in the table position. Further, when in the table position, front sides 93 of each support arm 38 and 39 are supported on respective main panels 84 of locking brackets 80 and 81. Although locking brackets 80 and 81 act as both a locking mechanism to retain back support 36 in an upright position, and as a support for back support 36 when in a table position, it is contemplated that two separate elements could be utilized to perform these two separate functions.

Figure 5:
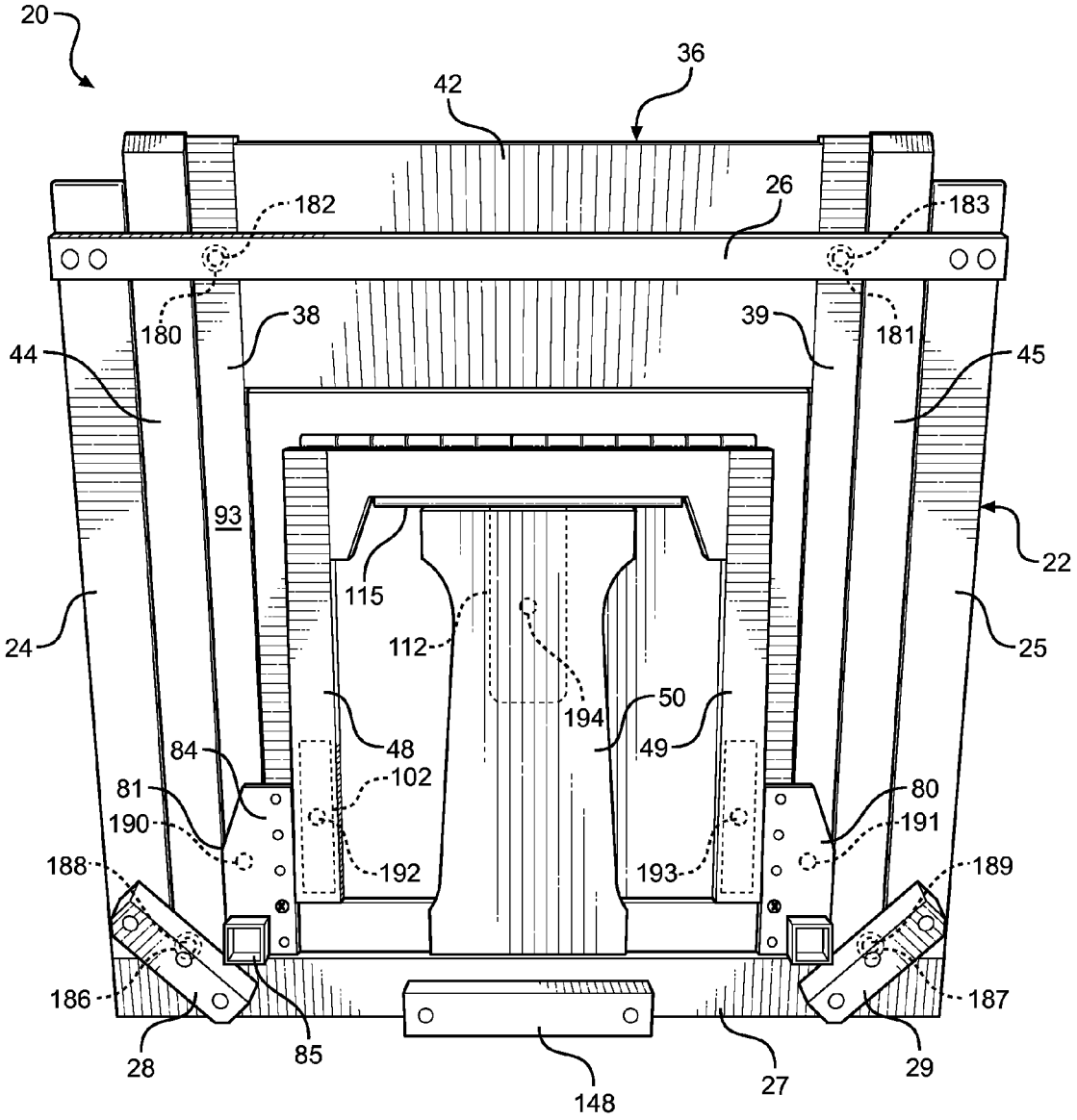
FIG. 5 is a view of the bottom of the convertible chair of FIG. 1 in a storage position.
Figure 6:
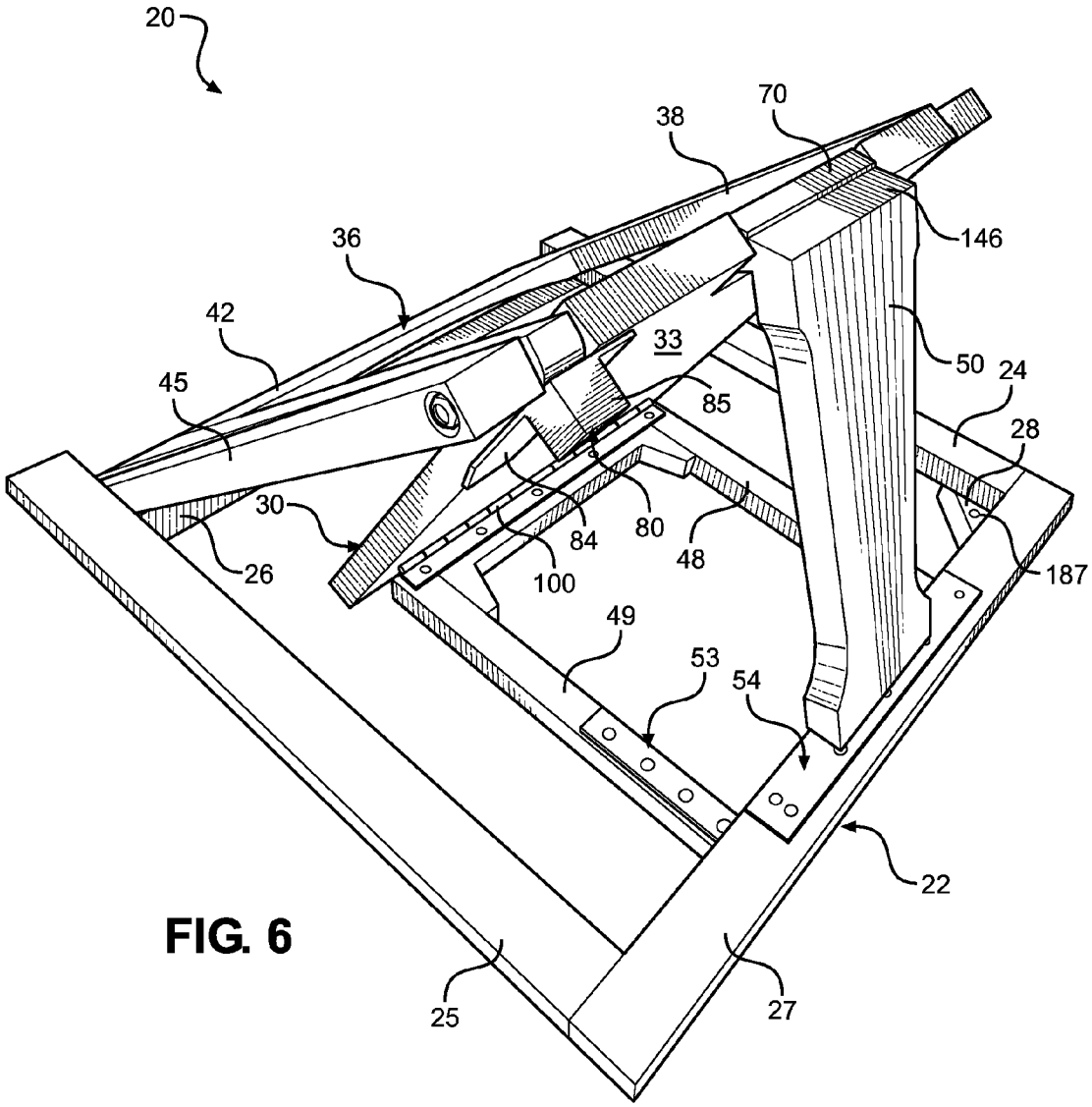
FIG. 6 is a perspective view of the convertible chair of FIG. 1 being folded into a storage position.
Figure 7:
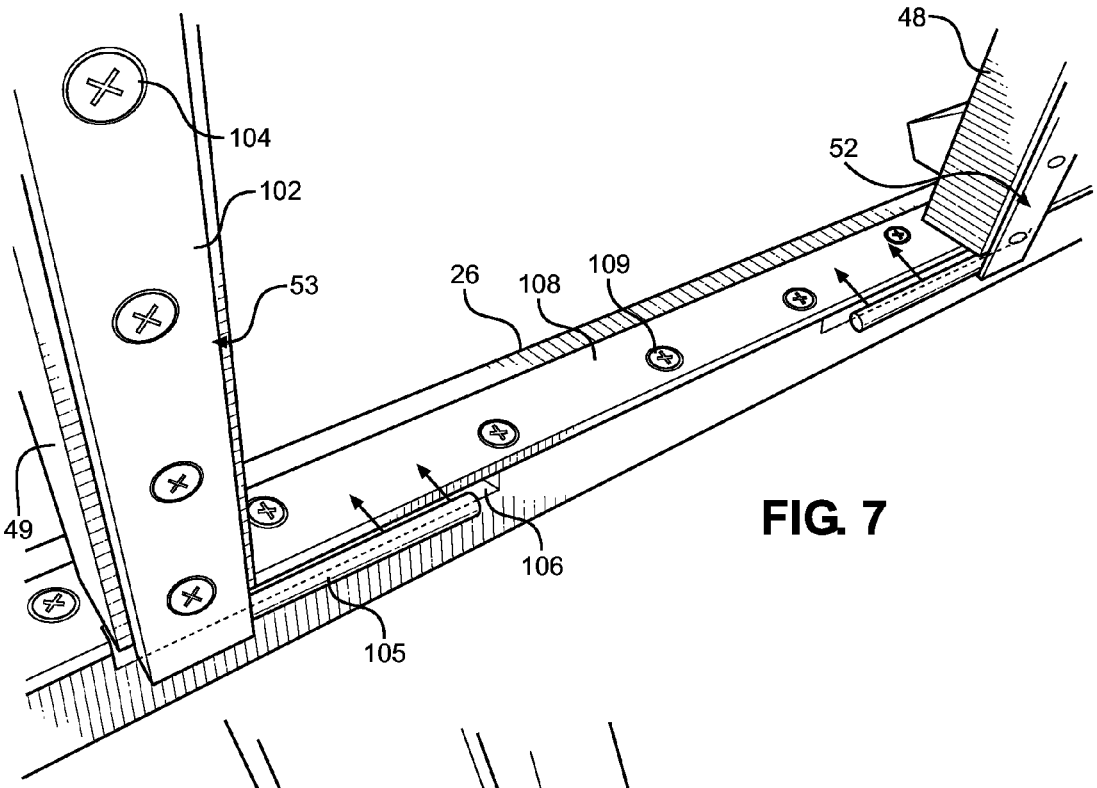
FIG. 7 is a perspective view of front chair leg connecting assemblies.
Figure 8:
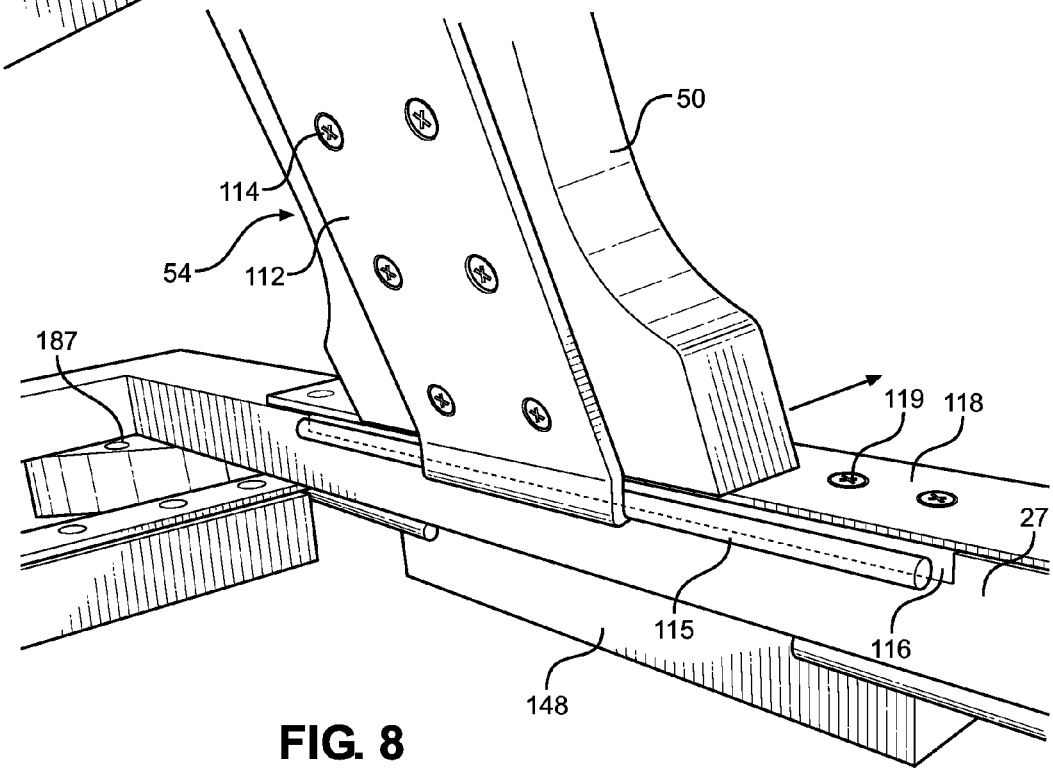
FIG. 8 is a perspective view of a back chair leg connecting assembly.

In a preferred embodiment, chair 20 is a folding chair capable of folding into an essentially flat storage position depicted in FIG. 5. Reference will now be made to FIGS. 6 and 7 in describing the manner in which front legs 48 and 49 can be moved from a chair or table position, to a storage position. As depicted in FIG. 6, front legs 48 and 49 are pivotally connected to seat 36 through at least one hinge 100. Additionally, as previously noted, front legs 48 and 49 can be selectively connected to base frame 22 through connecting assemblies 52 and 53. As best seen in FIG. 7, each connecting assembly 52 and 53 includes a main bracket 102 configured to be connected to respective front legs 48 and 49 by fasteners 104, such as screws or the like. Each connecting assembly 52 and 53 further includes a retaining bar 105 extending there from, which is sized to be received in an aperture 106 formed between front connecting arm 26 of base frame 22 and a reinforcing bracket 108 connected to front connecting arm 26 through fasteners 109, such as screws or the like. When retaining bars 105 are fit into respective apertures 106, respective legs 48 and 49 are retained in an upright position. Similar to front legs 48 and 49, back leg 50 is pivotally connected to seat 30 via main hinge assembly 43, as depicted in FIG. 3. As previously noted, back leg 50 further includes connecting assembly 54. Like connecting assemblies 52 and 53, connecting assembly 54 includes a main bracket 112 configured to be connected to back leg 50 via fasteners 114, such as screws or the like, as depicted in FIG. 8. A retaining bar 115 extends from either side of main bracket 112, and is sized to fit within an aperture 116 defined between back connecting arm 27 and a reinforcing bracket 118 fastened to connecting arm 27 via fasteners 119, such as screws or the like. Optionally, a swing latch or other locking means could be utilized to lock retaining bars 105, 115 in place within respective apertures 106, 116.

Figure 9:
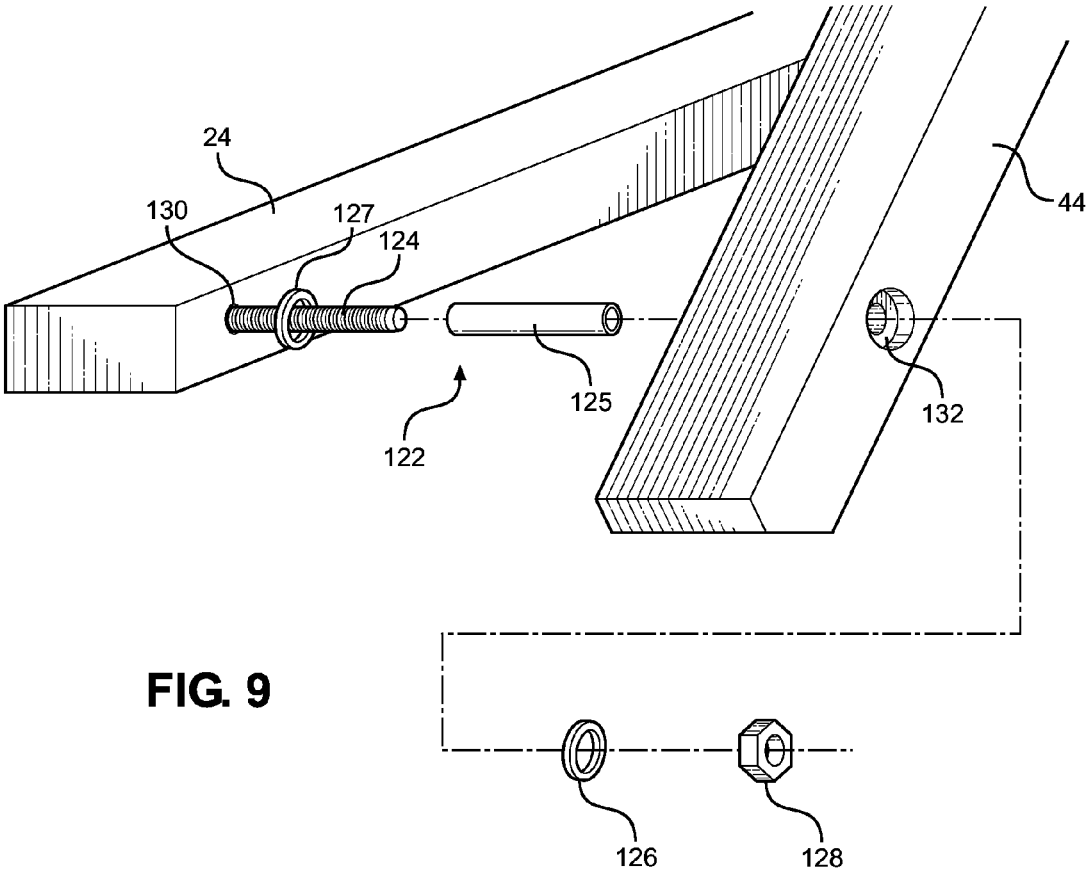
FIG. 9 is an exploded view of a support beam pivot assembly.

In the preferred embodiment, each angled support beam 44 and 45 is pivotally connected to a respective side arm 24, 25 of base frame 22 by a pivotal connector or hinge assembly generally indicated at 122, as depicted in FIG. 9. Pivot assemblies 122 are a mirror image of one another and, therefore, only one side of chair 20 will be discussed with reference to FIG. 9. Pivot assembly 122 includes a hanger bolt 124, a rigid sleeve 125, a pair of washers 126, 127 and a nut 128. During assembly, bolt 124 is screwed into a hole 130 in side arm 24 of base frame 22, through rigid sleeve 125, and through a channel 132 extending through angled support 44. Washers 126 and 127 and nut 128 are affixed to bolt 124 in a manner well known in the art, to secure side arm 24 to angled support 44. Sleeve 125 is slightly wider than angled support 44 so that, when nut 128 is tightened, sleeve 125 is compressed against washers 126 and 127, allowing angled support 44 to pivot freely.

In use, a user can push front legs 48 and 49 toward back leg 50 to disengage retaining bars 105 from apertures 106, and rotate front legs 48 and 49 with respect to seat 30 via hinge 100. Likewise, back leg 50 can be pushed towards front legs 48 and 49 to disengage retaining bar 115 from aperture 116, and rotate back leg 50 with respect to seat 30 via main hinge assembly 43. As front and back legs 48-50 are pivoted into a folded position, a user can lower seat 30 and back support 36 by pivoting angled support beams 44 and 45 with respect to the base frame 22 and seat and back support portions 30 and 36, until the entire assembly is lying in an essentially flat, folded storage position, as depicted in FIG. 5. In this folded storage position, back 36 rests against front connecting arm 26 of base frame 22 and is essentially coplanar with angled support beams 44 and 45, as well as first and second opposing side arms 24 and 25 of base frame 22. Additionally, it is noted that braces 28 and 29 act as stops when in the folded position. Optionally, magnets could be provided on braces 28 and 29, such that braces 28 and 29 would be attracted to metal disks bonded to angled support beams 44 and 45 in order to aid in retaining chair 20 in the folded position.

Figure 10:
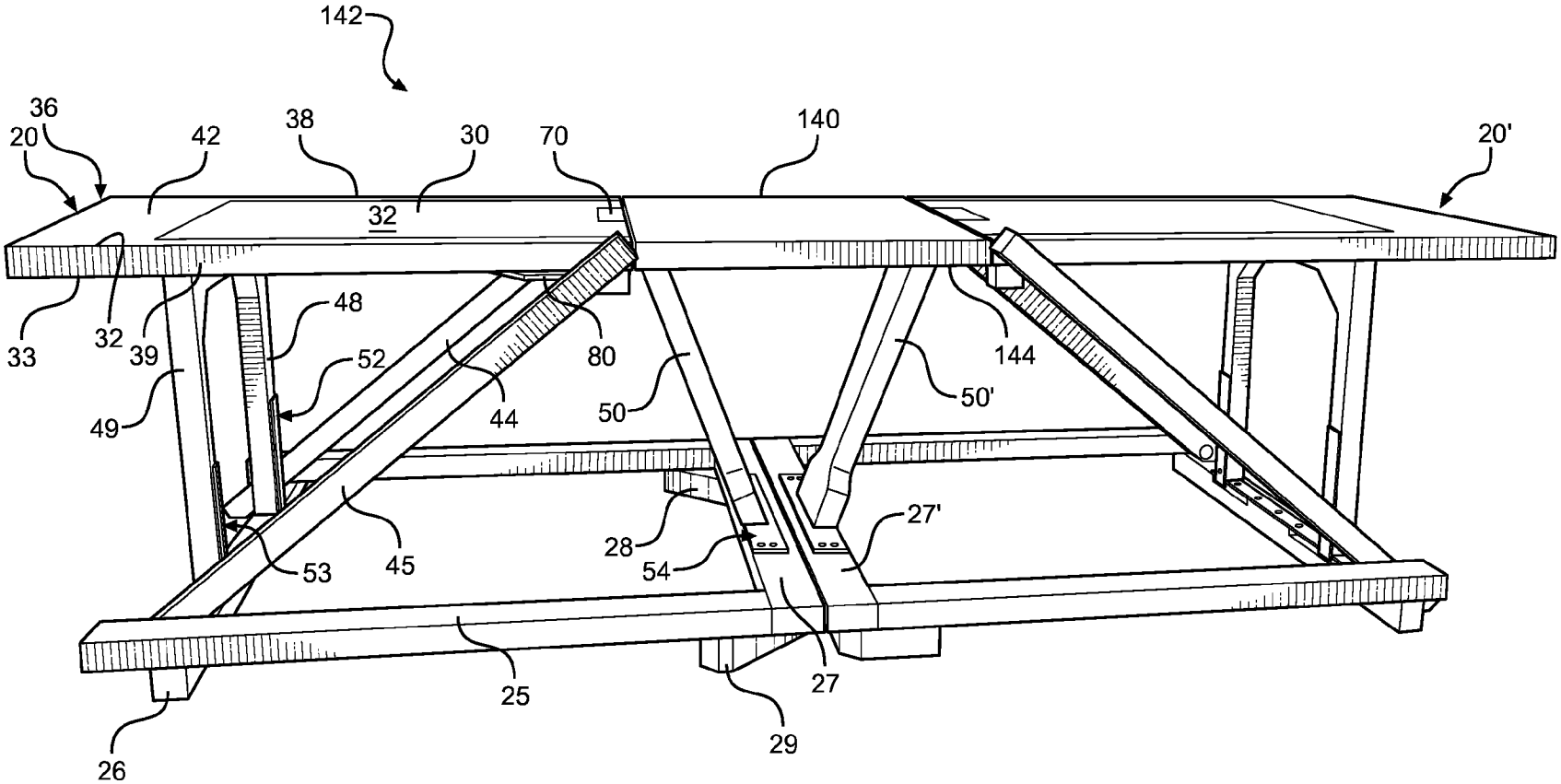
FIG. 10 is a perspective view of two convertible chairs of the present invention utilized in an extended table configuration.

FIG. 10 depicts another embodiment of the present invention, wherein a table leaf 140 is provided, which enables a user to convert a pair of chairs (e.g. chair 20 and chair 20') into an extended table 142. More specifically, when a user wishes to utilize extended table 142, the user simply converts two chairs 20, 20' to the folded table position as discussed above, positions respective back connecting arms 27 and 27' adjacent one another, and places table leaf 140 between chairs 20 and 20', such that a bottom surface 144 of table leaf 140 is resting upon a leaf supporting top surface 146 (depicted in FIGS. 1-4 and 6) of respective back legs 50, 50'. Additional features may be utilized to retain chairs 20, 20' and table leaf 140 in the extended table configuration, such as various well known locking mechanisms, catches, etc.

Although described with reference to a preferred embodiment of the invention, it should be readily understood that various changes and/or modifications can be made to the invention without departing from the spirit thereof. For instance, various means for leveling chair 20 can be utilized, such as a leveling block 148 depicted in FIG. 8, which positions back connected arm 27 at a desired height with respect to the other base frame members.

Figure 11A:
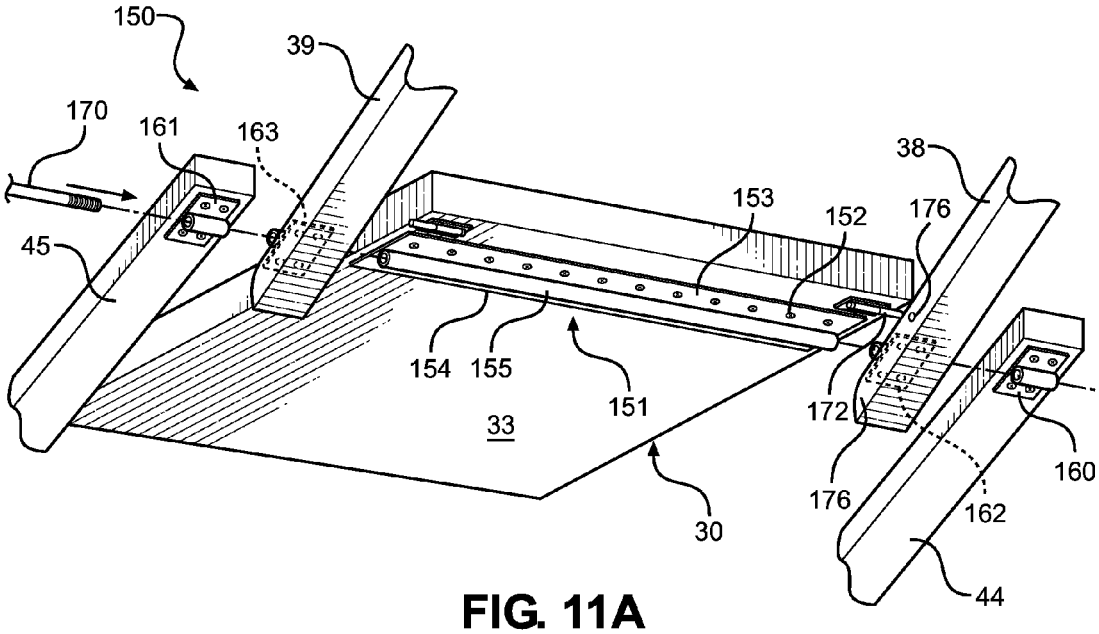
FIG. 11A is an exploded perspective view of an alternative main hinge assembly for use with the present invention.
Figure 11B:
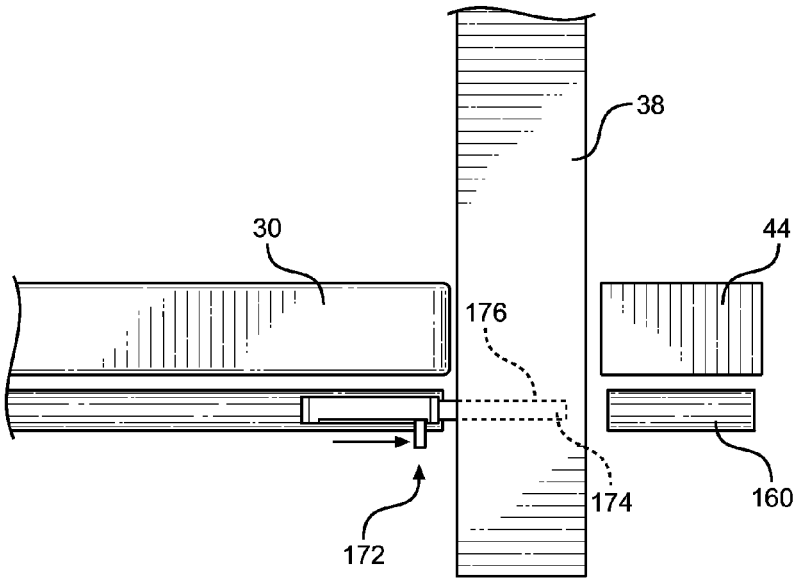
FIG. 11B is a partial cross-sectional view of a locking mechanism for use with the alternative main hinge assembly of FIG. 11A.

Additionally, it is noted that main hinge assembly 43 is a preferred means for pivoting various chair elements. However, different means for pivoting chair elements can be utilized without departing from the spirit of the invention. For example, FIGS. 11A and 11B depict an alternative main hinge assembly 150. Hinge assembly 150 includes a main hinge panel 151 configured to be fastened to lower surface 33 of seat 30 via fasteners 152 extending through apertures in opposing flanges 153, 154. Hinge panel 151 further includes a hollow metal retaining tube 155. Similar to main hinge panel 151, first and second minor hinge panels 160 and 161 are connected to respective angled support beams 44 and 45, and third and fourth minor panels 162 and 163 are connected to respective first and second support arms 38 and 39. Each minor hinge panel includes a metal retaining tube and opposing flanges (not separately labeled). A support rod 170 extends through the metal retaining tubes of each hinge panel 151 and 160-163 to connect chair elements 30, 38, 39, 44 and 45 in a pivotal manner. Although not shown, it should be understood that back leg 50 may be connected to seat 30 in this embodiment via the same hinge 151.

Additionally, with reference to FIG. 11B, main hinge assembly 150 includes at least one well known bolt-type locking mechanism indicated at 172. A bolt 174 located adjacent to main hinge panel 151 may be manually slid into a locking recess 176 located within respective support arms 38 and 39, to lock supporting arms 38 and 39 in place with respect to seat 30. With this configuration, it should be understood that chair 20 can be locked in an upright position, or locked in a folded, table position.

In a preferred embodiment, chair 20 also includes at least one magnet at a first location on the chair and at least one metal component at a second location on the chair such that, when the chair is in the folded position, the at least one magnet magnetically engages the at least one metal component to aid in retaining the chair in the folded position. An example of how magnets may be utilized can be seen in FIG. 5. In particular, FIG. 5 depicts metal disks 180 and 181 located on front sides 93 of respective first and second opposing supports 38 and 39. Metal disks 180 and 181 are located opposite magnets 182, 183 located on front connecting arm 26, and are in magnetic engagement with the magnets 182, 183 when chair 20 is in the folded position. Additional magnets 186, 187 may be located on diagonal braces 28 and 29, such that the magnets 186 and 187 engage respective metal discs 188, 189 located on end portions of first and second angled support beams 44 and 45 when chair 20 is in the folded position. Magnets 190, 191 may also be placed on respective first and second opposing supports 38 and 39 opposite metal locking brackets 80 and 81. Further, magnets 192, 193 and 194 may be placed on the bottom of seat 30, such that magnets 192 and 193 engage respective metal main brackets 102 of front legs 48 and 49, and magnet 194 engages metal main bracket 112 of back leg 50.

Figure 12:
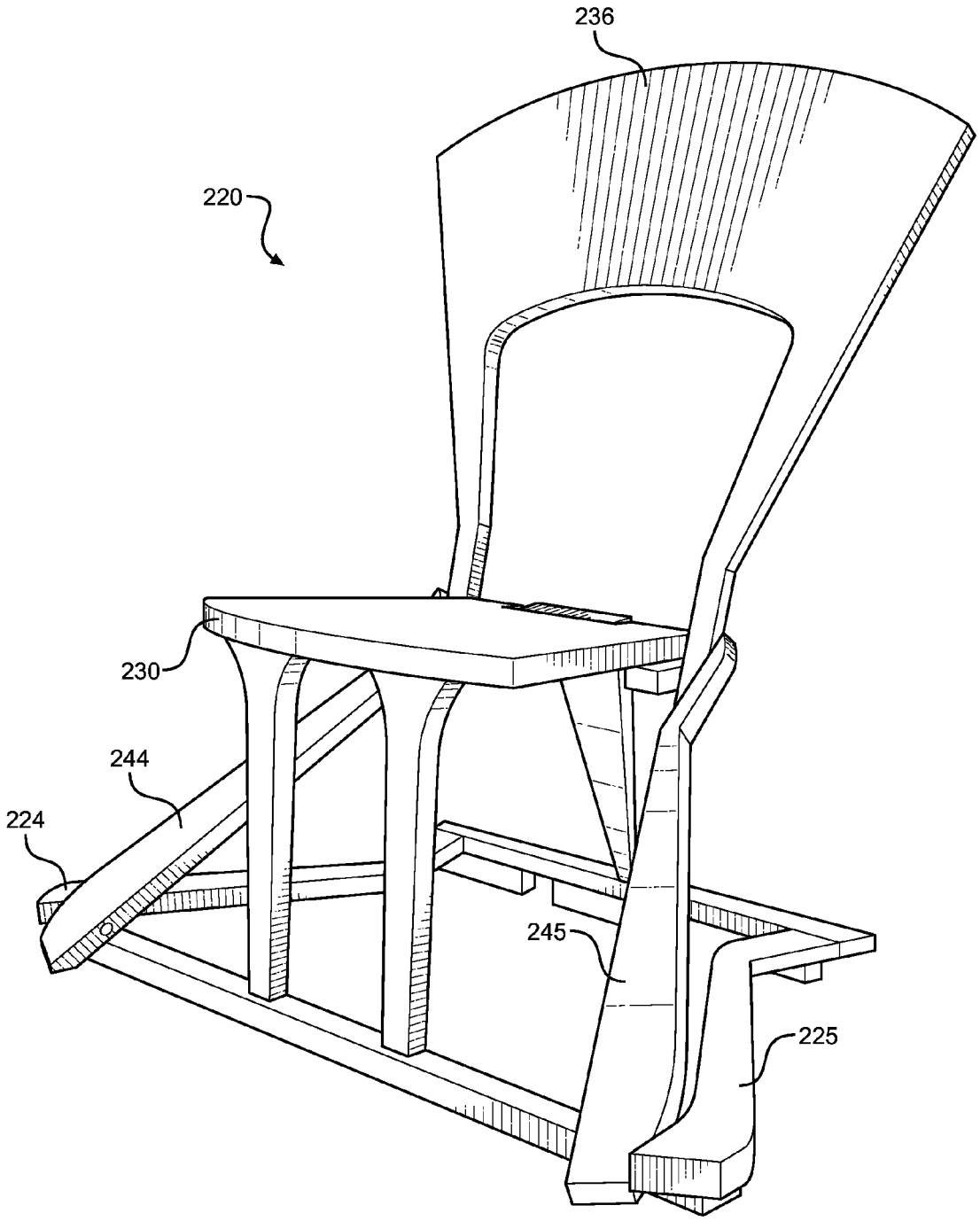
FIG. 12 is a perspective view of an alternative convertible chair of the present invention.

Lastly, with respect to FIG. 12, it should be understood that the design of chair 20 can be altered to appeal to different user aesthetics without departing from the invention. For example, FIG. 12 depicts a clam shell style chair 220 that features curved elements such as curved opposing side arms 224, 225, seat 230, back support 236 and angled support beams 244, 245. It should be understood that chair 220 can be converted between an upright chair position, lowered table position, and substantially flat storage position in the same manner as discussed above with respect to chair 20. In general, the invention is only intended to be limited by the scope of the following claims.

I claim:

1. A convertible chair comprising:

a base frame;

a seat having upper and lower opposing surfaces, wherein the seat is connected to said base frame through first, second, and third legs;

a back support including a main panel connected to the seat via first and second support arms; and at least one hinge assembly interconnecting the seat and back support, such that a user can pivot the back support from an upright chair position, wherein the back support extends at an angle from said seat, to a table position, wherein the upper surface of the seat and a back side surface of the back support form an essentially planar table surface.

2. The convertible chair of claim 1, further comprising:

a locking mechanism for retaining the first and second support arms in an upright position with respect to the seat when the chair is in the upright chair position.

3. The convertible chair of claim 2, further comprising:

first and second angled support beams, each attached at a first end thereof to a respective one of the first and second support arms, and attached at a second end thereof to the base frame.

4. The convertible chair of claim 3, wherein the locking mechanism is in the form of first and second locking brackets attached to opposing sides of the seat adjacent respective first and second support arms, each of the first and second locking brackets including an arm retaining portion; and the at least one hinge assembly includes a support rod extending through channels formed in respective angled support beams, apertures formed through respective support arms, a main channel formed through the seat, and an aperture formed through a top portion of the third leg; wherein the apertures in the support arms are sized to enable the support rod to slide within the apertures such that lower ends of respective support arms may be positioned within respective arm retaining portions of the first and second locking brackets when the chair is in the upright chair position, and the lower ends of respective support arms may be withdrawn from the first and second locking brackets when the chair is in the table position.

5. The convertible chair of claim 4, wherein the first and second locking brackets further include respective main panel portions extending from the arm retaining portions, wherein, when the convertible chair is in the table position, a front side of the first support arm is supported by the main panel portion of the first locking bracket and a front side of the second support arm is supported by the main panel portion of the second locking bracket.

6. The convertible chair of claim 1, further comprising:

first and second pivotal connectors connecting respective first and second angled support beams to the base frame, such that the first and second angled support beams can pivot with respect to the base frame to transition the chair between the upright chair position to a folded, storage position;

at least one hinge assembly connecting the first and second legs to the seat;

a first connecting assembly removably connecting the first leg to the base frame;

a second connecting assembly removably connecting the second leg to the base frame;

a third connecting assembly removably connecting the third leg to the base frame; and wherein the first, second and third legs are configured to be connected to the base frame through respective first, second, and third connecting assemblies when the convertible chair is in an upright chair position, and wherein the first, second, and third legs are configured to be disconnected from the base frame and folded into a position adjacent the seat when the convertible chair is in the folded, storage position.

7. The convertible chair of claim 6, wherein each of the first, second, and third connecting assemblies includes a main bracket connected to a respective first, second and third leg via fasteners, and a retaining bar extending from the main bracket, wherein the retaining bar is adapted to fit within respective first, second, and third apertures in the base frame to retain each of the first, second, and third legs in an upright position.

8. The convertible chair of claim 6, further comprising:

at least one magnet at a first location on the chair; and at least one metal component at a second location on the chair such that, when the chair is in the folded position, the at least one magnet magnetically engages the at least one metal component to aid in retaining the chair in the folded, storage position.

9. The convertible chair of claim 1, wherein the base frame includes first and second opposing side arms and first and second connecting arms extending between said first and second opposing side arms to form a substantially rectangular base frame.

10. An extended table assembly comprising:

a first convertible chair including:

a base frame;

a seat having upper and lower opposing surfaces, wherein the seat is connected to said base frame through first, second, and third legs;

a back support including a main panel connected to the seat via first and second support arms;

a leaf supporting surface; and at least one hinge assembly interconnecting the seat and back support, such that a user can pivot the back support from an upright chair position, wherein the back support extends at an angle from said seat to a table position, wherein the upper surface of the seat and a back side surface of the back support form an essentially planar table surface;

a second convertible chair including:

a base frame;

a seat having upper and lower opposing surfaces, wherein the seat is connected to said base frame through first, second, and third legs;

a back support including a main panel connected to the seat via first and second support arms;

a leaf supporting surface; and at least one hinge assembly interconnecting the seat and back support, such that a user can pivot the back support from an upright chair position, wherein the back support extends at an angle from said seat to a table position, wherein the upper surface of the seat and a back side surface of the back support form an essentially planar table surface; and a table leaf sized to fit between the first and second convertible chairs when the chairs are in a table position, and back arms of the respective base frames are positioned adjacent one another, wherein the table leaf is supported by respective leaf supporting surfaces of the first and second convertible chairs.

11. A convertible chair comprising:

a base frame;

a seat having upper and lower opposing surfaces, wherein the seat is connected to said base frame through first, second, and third legs;

a back support including a main panel connected to the seat via first and second support arms; and means for pivoting the back support from an upright chair position, wherein the back support extends at an angle from said seat, to a table position, wherein the upper surface of the seat and a back side surface of the back support form an essentially planar table surface.

12. The convertible chair of claim 10, further comprising:

locking means for locking at least one of the first and second support arms in an upright position with respect to the seat when the chair is in the upright chair position.

13. The convertible chair of claim 11, further comprising:

first and second angled support beams, each attached at a first end thereof to a respective one of the first and second support arms, and attached at a second end thereof to the base frame.

14. The convertible chair of claim 11, further comprising:

first and second pivotal connectors connecting respective first and second angled support beams to the base frame, such that the first and second angled support beams can pivot with respect to the base frame to transition the chair between the upright chair position to a folded, storage position;

at least one hinge assembly connecting the first and second legs to the seat;

a first connecting assembly removably connecting the first leg to the base frame;

a second connecting assembly removably connecting the second leg to the base frame;

a third connecting assembly removably connecting the third leg to the base frame; and wherein the first, second and third legs are configured to be connected to the base frame through respective first, second, and third connecting assemblies when the convertible chair is in an upright chair position, and wherein the first, second, and third legs are configured to be disconnected from the base frame and folded into a position adjacent the seat when the convertible chair is in the folded, storage position.

15. The convertible chair of claim 14, wherein each of the first, second, and third connecting assemblies includes a main bracket connected to a respective first, second and third leg via fasteners, and a retaining bar extending from the main bracket, wherein the retaining bar is adapted to fit within respective first, second, and third apertures in the base frame to retain each of the first, second, and third legs in an upright position.

16. The convertible chair of claim 14, further comprising:

at least one magnet at a first location on the chair; and at least one metal component at a second location on the chair such that, when the chair is in the folded position, the at least one magnet magnetically engages the at least one metal component to aid in retaining the chair in the folded, storage position.

17. The convertible chair of claim 11, wherein the base frame includes first and second opposing side arms and first and second connecting arms extending between said first and second opposing side arms to form a substantially rectangular base frame.

* * * * *